US009972952B2

(12) United States Patent
Guo

(10) Patent No.: US 9,972,952 B2
(45) Date of Patent: May 15, 2018

(54) ELECTRICAL CONNECTOR WITH IMPROVED TERMINALS ARRAY

(71) Applicant: FOXCONN INTERCONNECT TECHNOLOGY LIMITED, Grand Cayman (KY)

(72) Inventor: Jing-Jie Guo, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days. days.

(21) Appl. No.: 15/088,159

(22) Filed: Apr. 1, 2016

(65) Prior Publication Data

US 2016/0294130 A1 Oct. 6, 2016

(30) Foreign Application Priority Data

Apr. 2, 2015 (CN) ..... 2015 1 0153827
Jun. 16, 2015 (CN) ..... 2015 1 0331536

(51) Int. Cl.

| | |
|---|---|
| ***H01R 24/00*** | (2011.01) |
| ***H01R 24/60*** | (2011.01) |
| ***H01R 13/6467*** | (2011.01) |
| *H01R 13/6581* | (2011.01) |
| *H01R 107/00* | (2006.01) |

(52) U.S. Cl.

CPC ..... *H01R 24/60* (2013.01); *H01R 13/6467* (2013.01); *H01R 13/6581* (2013.01); *H01R 2107/00* (2013.01)

(58) Field of Classification Search

CPC ..... H01R 13/6467; H01R 24/60; H01R 13/6581; H01R 2107/00

USPC ..... 439/607.01, 607.4, 660, 676

See application file for complete search history.

(56) References Cited

U.S. PATENT DOCUMENTS 8,157,599 B2 * 4/2012 Wei ..... H01R 13/502 439/607.01
8,864,526 B2 10/2014 Kim et al.
8,882,540 B2 * 11/2014 Yen ..... H01R 13/6581 439/489

(Continued)

FOREIGN PATENT DOCUMENTS

CN 201278410 7/2009
CN 203859265 10/2014

(Continued)

*Primary Examiner* — Abdullah Riyami
*Assistant Examiner* — Nelson R Burgos-Guntin
(74) *Attorney, Agent, or Firm* — Wei Te Chung; Ming Chieh Chang

(57) ABSTRACT

An electrical connector includes an insulative housing having a tongue portion, a number of terminals having a number of first contacts and second contacts, and a shielding shell attached to the housing. The tongue portion defines a first surface and a second surface. Each first contact has a first contacting portion exposed from the first surface, a first soldering portion, and a first connecting portion. Each second contact has a second contacting portion exposed from the second surface, a second soldering portion, and a second connecting portion. The first contacts have a first outermost contact, and the first contacting portion of the first outermost contact offsets outwardly beyond the second contacting portion along a transverse direction.

12 Claims, 12 Drawing Sheets

(56) References Cited

U.S. PATENT DOCUMENTS

| | | | | |
|---|---|---|---|---|
| 8,926,367 | B2 * | 1/2015 | Hsu | H01R 13/658 439/607.35 |
| 9,136,636 | B2 * | 9/2015 | Zhang | H01R 13/516 |
| 9,209,573 | B1 * | 12/2015 | Chen | H01R 13/6581 |
| 9,455,535 | B1 * | 9/2016 | Chiang | H01R 13/6585 |
| 9,478,923 | B2 * | 10/2016 | Kao | H01R 24/60 |
| 9,496,664 | B2 * | 11/2016 | Little | H01R 13/6587 |
| 2014/0065889 | A1 | 5/2014 | Zhang et al. | |
| 2014/0235109 | A1 * | 8/2014 | Tanaka | H01R 24/76 439/660 |
| 2014/0364013 | A1 * | 12/2014 | Yu | H01R 13/193 439/660 |
| 2015/0065889 | A1 | 3/2015 | Gandelman et al. | |
| 2015/0155659 | A1 * | 6/2015 | Yu | H01R 13/642 439/676 |
| 2015/0194772 | A1 * | 7/2015 | Little | H01R 13/6597 439/357 |
| 2015/0206209 | A1 | 7/2015 | Sandstrom | |
| 2016/0118746 | A1 * | 4/2016 | Dong | H01R 13/64 439/676 |
| 2016/0181733 | A1 * | 6/2016 | Duan | H01R 13/6594 439/607.05 |
| 2016/0181744 | A1 * | 6/2016 | Kao | H01R 24/60 439/676 |

FOREIGN PATENT DOCUMENTS

| | | |
|---|---|---|
| CN | 204067706 | 12/2014 |
| CN | 204333335 | 5/2015 |
| TW | M409560 | 8/2011 |
| TW | M508136 | 5/2015 |

* cited by examiner

ELECTRICAL CONNECTOR WITH IMPROVED TERMINALS ARRAY

BACKGROUND OF THE INVENTION

1. Field of the Invention

The present invention relates to an electrical connector, and more particularly to an electrical connector with improved terminals array.

2. Description of Related Art

The Universal Serial Bus and USB connectors are well known in the art. China Patent No. 203859265 discloses a reversible electrical connector. The electrical connector includes an insulative housing having a tongue portion, and a number of first contacts and second contacts retained in the insulative housing. The tongue portion defines a first surface and a second surface. Each of the first contacts has a first contacting portion retained in the first surface and a first soldering portion. Each of the second contacts has a second contacting portion retained in the second surface and a second soldering portion. The first soldering portions and the second soldering portions are located in a line. China Patent No. 204067706 discloses a reversible electrical connector. The electrical connector includes an insulative housing having a tongue portion, and two arrays of contacts retained in the insulative housing. The tongue portion defines a first surface and a second surface to respectively receive the contacts. Each of the contacts has a connecting portion. Part of the connecting portions has a number of soldering extending through the housing, and rest shares the soldering portions. The soldering portions are located in a line. U.S. Pat. No. 20140206209 discloses a reversible electrical connector including a body, a dielectric base, a shell, two arrays of contacts, and two arrays of electrically conductive contact frames coupled to the contacts. A crossover region exists between two arrays of the contacts where portions of contact frames overlap and cross.

Hence, a new and simple electrical connector is desired.

SUMMARY OF THE INVENTION

Accordingly, the object of the present invention is to provide an electrical connector, comprising: an insulative housing having a base portion and a tongue portion extending forwardly from the base portion, the tongue portion defining a first surface and a second surface; a plurality of terminals disposed in the insulative housing and having a plurality of first contacts carried by the first surface and a plurality of second contacts carried by the second surface, each first contact having a first contacting portion exposed from the first surface, a first soldering portion extending from the base portion, and a first connecting portion connected with the first contacting portion and the first soldering portion, each second contact having a second contacting portion exposed from the second surface, a second soldering portion extending from the base portion, and a second connecting portion connected with the second contacting portion and the second soldering portion; and a shielding shell attached to the insulative housing, wherein the first contacts have a first outermost contact, and the first contacting portion of the first outermost contact offsets outwardly beyond the second contacting portion.

Other objects, advantages and novel features of the invention will become more apparent from the following detailed description when taken in conjunction with the accompanying drawings.

DETAILED DESCRIPTION OF THE PREFERRED EMBODIMENT

Figure 1:
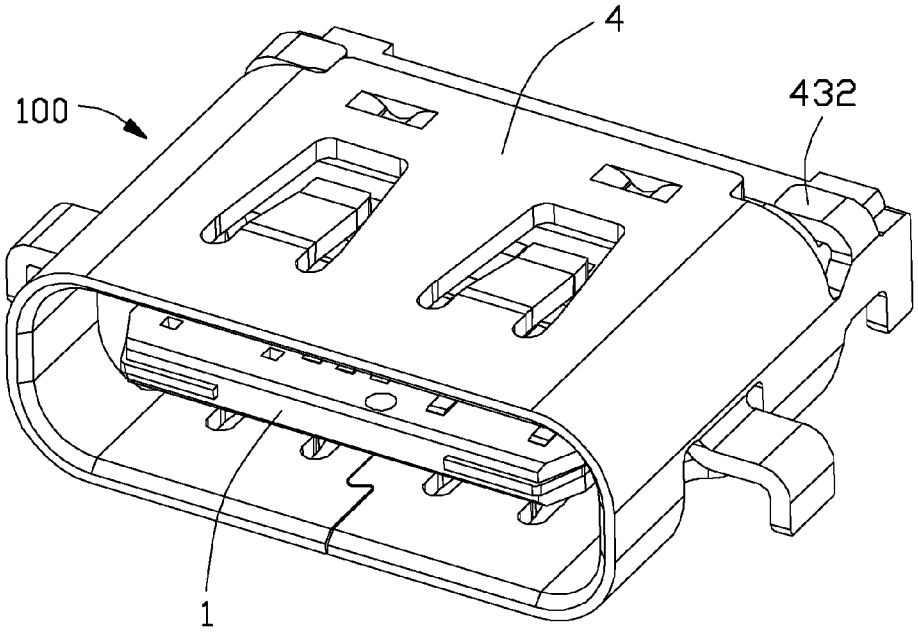
FIG. 1 is a perspective, assembled view of an electrical connector in a first embodiment.

Reference will now be made in detail to the preferred embodiment of the present invention.

FIGS. 1-7 show an electrical connector 100 in a first embodiment. For convenience, a mating direction and a transverse direction perpendicular to the mating direction are defined.

The electrical connector 100 includes an insulative housing 1, a number of terminals 2 and a metal sheet 3 retained in the insulative housing 1, and a shielding shell 4 formed with a mating cavity to receive the insulative housing 1.

Figure 2:
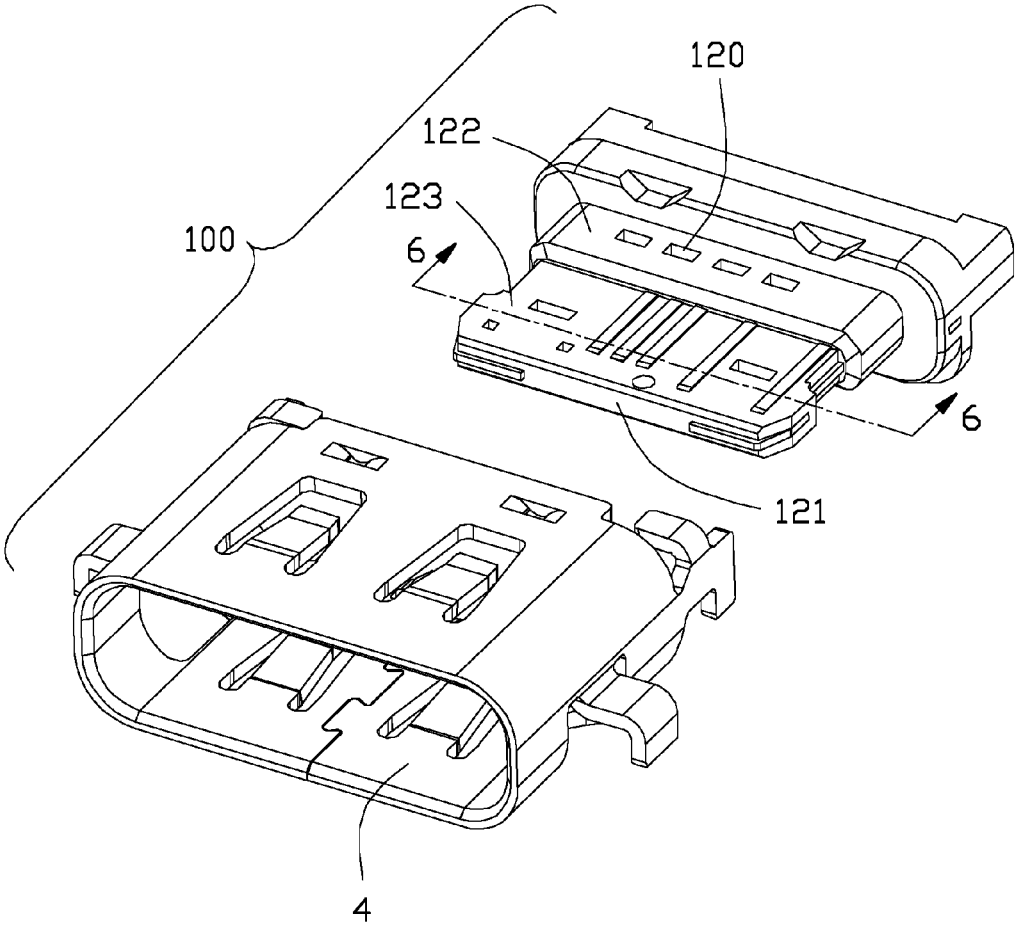
FIG. 2 is a perspective, assembled view of the electrical connector separated with a shielding shell of FIG. 1.
Figure 3:
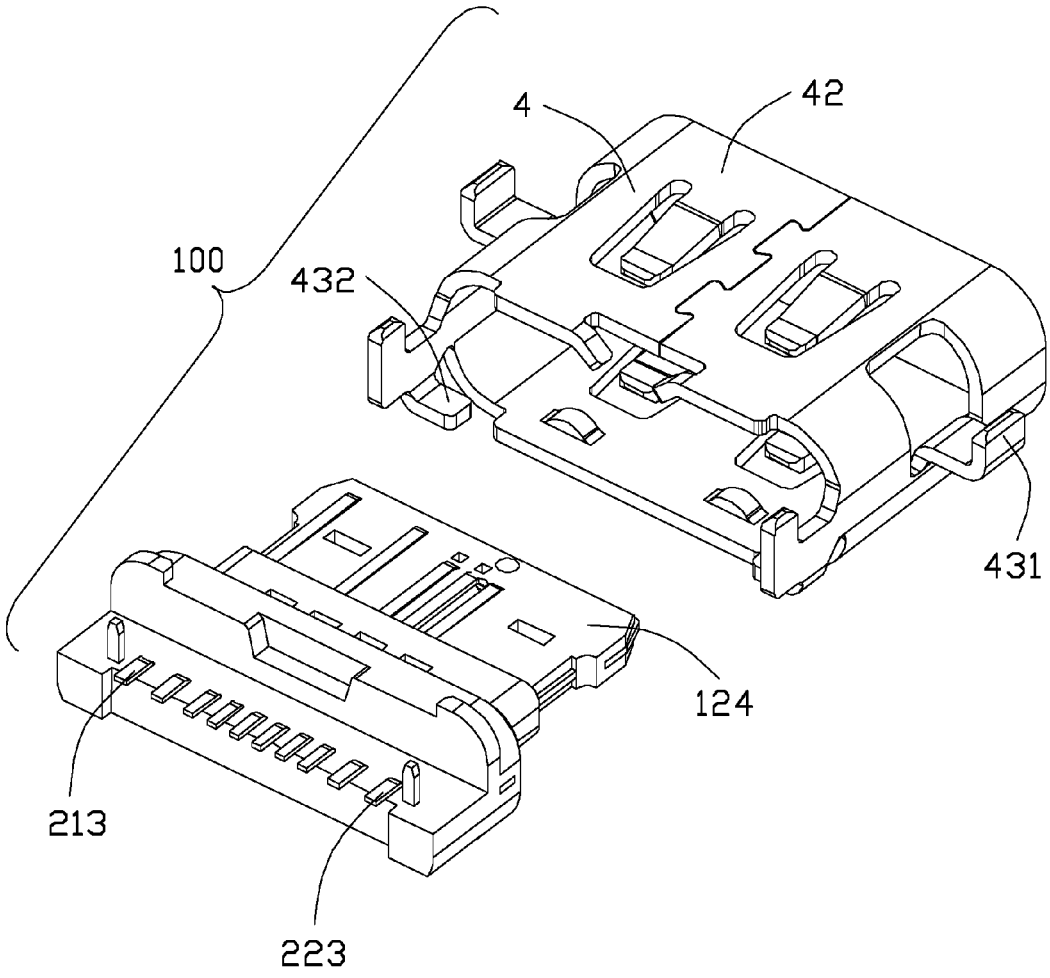
FIG. 3 is another perspective, assembled view of FIG. 2.
Figure 4:
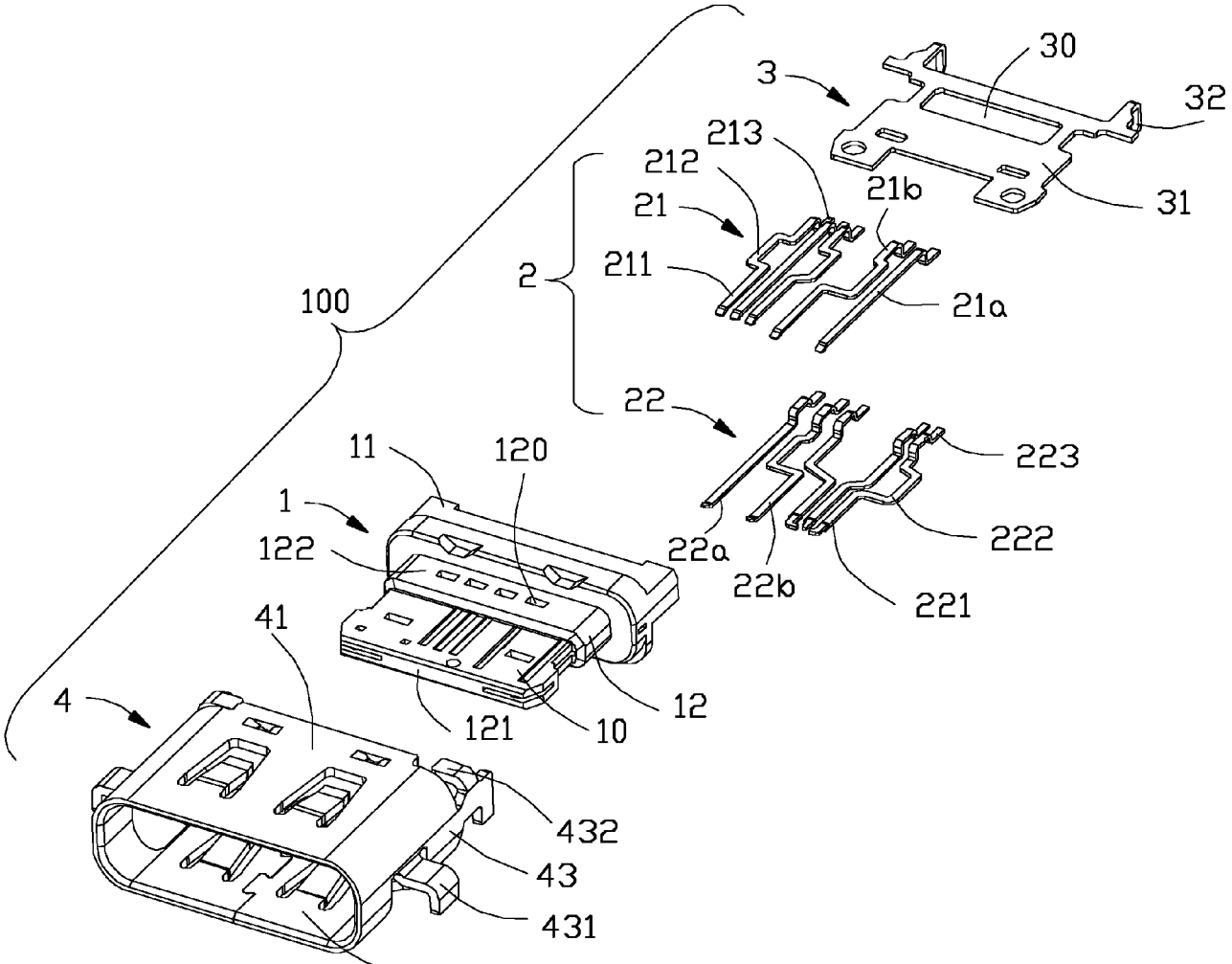
FIG. 4 is a perspective, exploded view of the electrical connector in the first embodiment.

Referring to FIGS. 2-4, the insulative housing 1 includes a base portion 11 and a tongue portion 12 extending forwardly from the base portion 11. The tongue portion 12 defines a first portion 121 located at a front end thereof and a second portion 122 extending backwardly from the first portion 121. The thickness of the first portion 121 is smaller than that of the second portion 122. The tongue portion 12 defines a first surface 123 and a second surface 124 disposed oppositely. The tongue portion 12 has a number of terminal-receiving slots located at the first surface 123 and the second surface 124. The second portion 122 has a number of orienting holes 120 to locate the terminals 2.

The terminals 2 include a number of first contacts 21 and a number of second contacts 22 carried by the tongue portion 12. Each of the first contacts 21 includes a first contacting portion 211 disposed in the first surface 123 of the tongue portion 12, a first connecting portion 212 retained in the second portion 122, and a first soldering portion 213 extending from a back end of the base portion 11. Each of the second contacts 22 includes a second contacting portion 221 disposed in the second surface 124 of the tongue portion 12, a second connecting portion 222 retained in the second portion 122, and a second soldering portion 223 extending from a back end of the second base portion 121. The first contacts 21 and the second contacts 22 are positioned to have 180 degree symmetry such that the corresponding plug connector can be inserted and operatively coupled to the electrical connector 100 in either of two orientations. The first soldering portion 21 and the second soldering portion 222 are located at a same plane and configured in a row.

Figure 5:
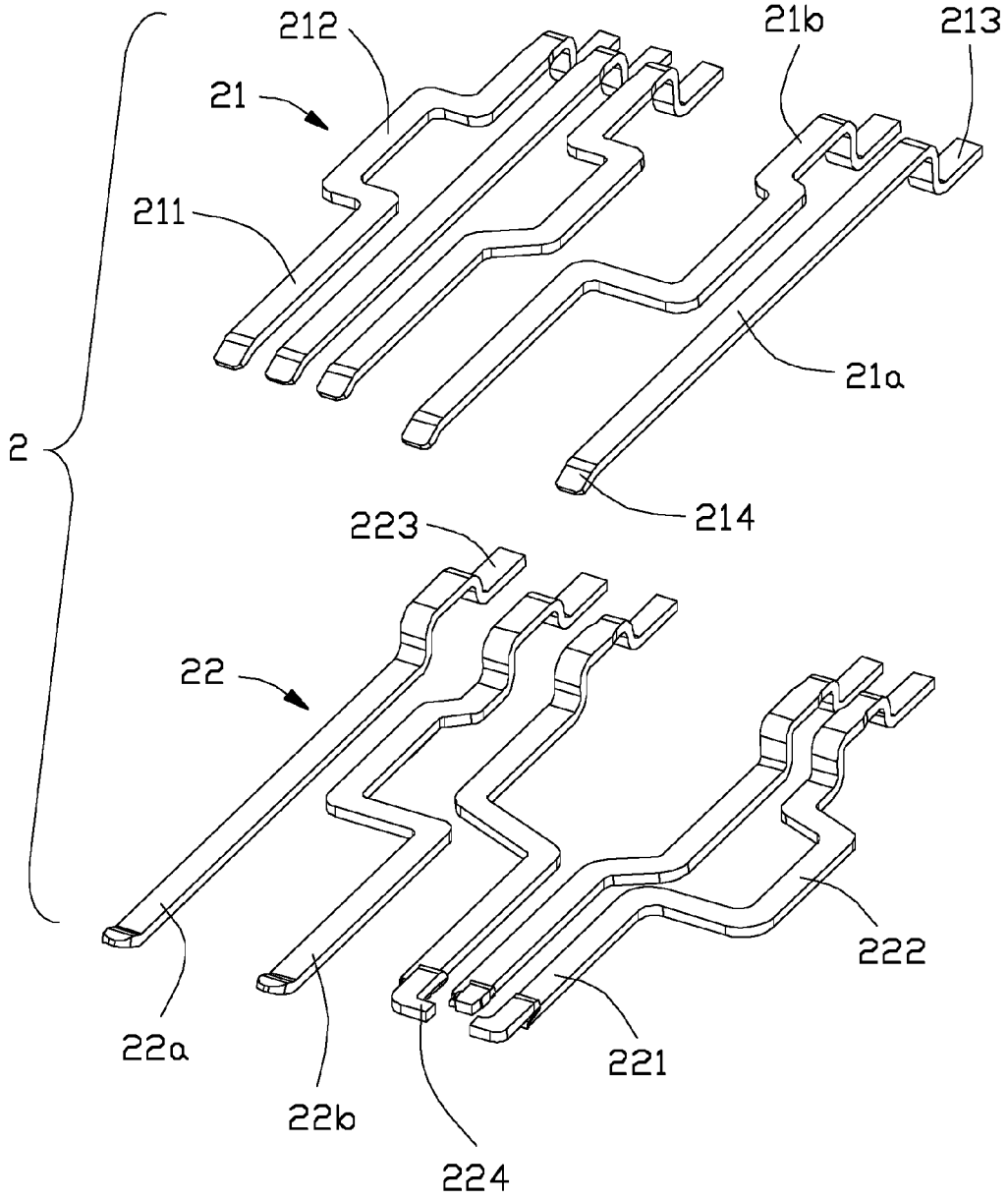
FIG. 5 is a perspective view of the contacts of the electrical connector in the first embodiment.
Figure 6:
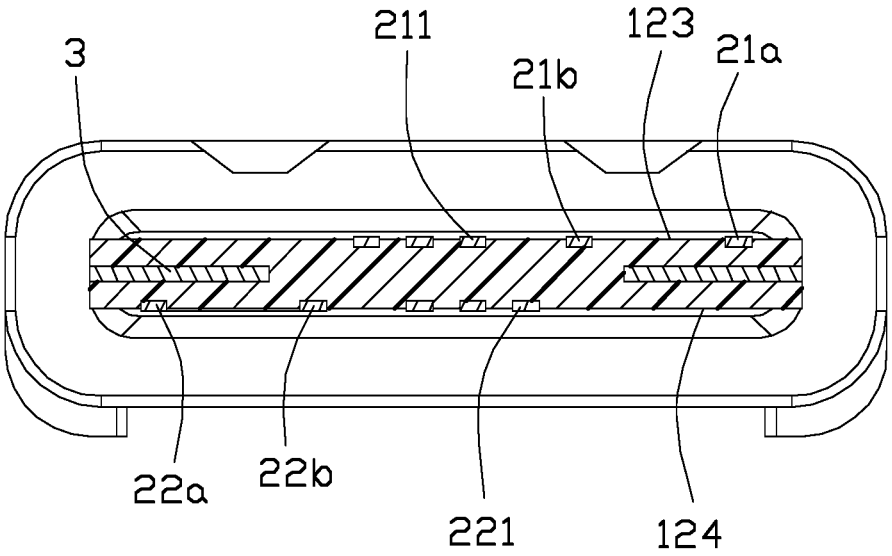
FIG. 6 is cross-sectional view of the electrical connector taken along line 6-6 in FIG. 2.

Referring to FIGS. 5-6, the first contacts 21 include a first outermost contact 21*a* located at an edge of the tongue portion 12, and a first lateral contact 21*b* located beside the first outermost contact 21*a*. The contacting portion 211 of the first outermost contact 21*a* offsets outwardly beyond the second contacting portion 221. The first lateral contact 21*b* and the first outermost contact 21*a* are staggered in a same direction so that the second contacting portion 221 of the first lateral contact 21*b* is not disposed in an area of the second surface 124 of the tongue portion 12 corresponding to that between the contacting portion 211 of the first outermost contact 21*a* and the second contacting portion 221 of the first lateral contact 21*b* in a preferred embodiment.

A distance between the first contacting portion 211 of the first outermost contact 21*a* and the second contacting portion 221 of the first lateral contact 21*b* is larger than that of the adjacent first contacting portions 211 of rest first contacts 21 except the first outermost contact 21*a* and the first lateral contact 21*b*. The contacting portions 211 of the first contacts 21 except the first outermost contact 21 a are offset a distance with the contacting portions 221 of the second contacts 22. Referring to FIG. 6, in another word, the first one in the left of the first contacts 21 is not aligned with the third one in the left of the second contacts 22 in an up-and-down direction and so on.

The second contacts 22 include a second outermost contact 22*a* located at an edge of the tongue portion 12, and a second lateral contact 22*b* located beside the second outermost contact 22*a* likewise. Free ends of the three close ones of the second contacting portions 221 are offset beyond the first contacting portion 211 so that the first contacting portions 211 attain enough pressing space. Two ones in the right of the first contacting portions 211 is not aligned with the second contacting portions 221 and two ones in the left of the second contacting portions 221 is not aligned with the first contacting portions 211. Referring to FIG. 6, the first contacting portions 211 and the second contacting portions 221 offset to different directions along the transverse direction.

Figure 7:
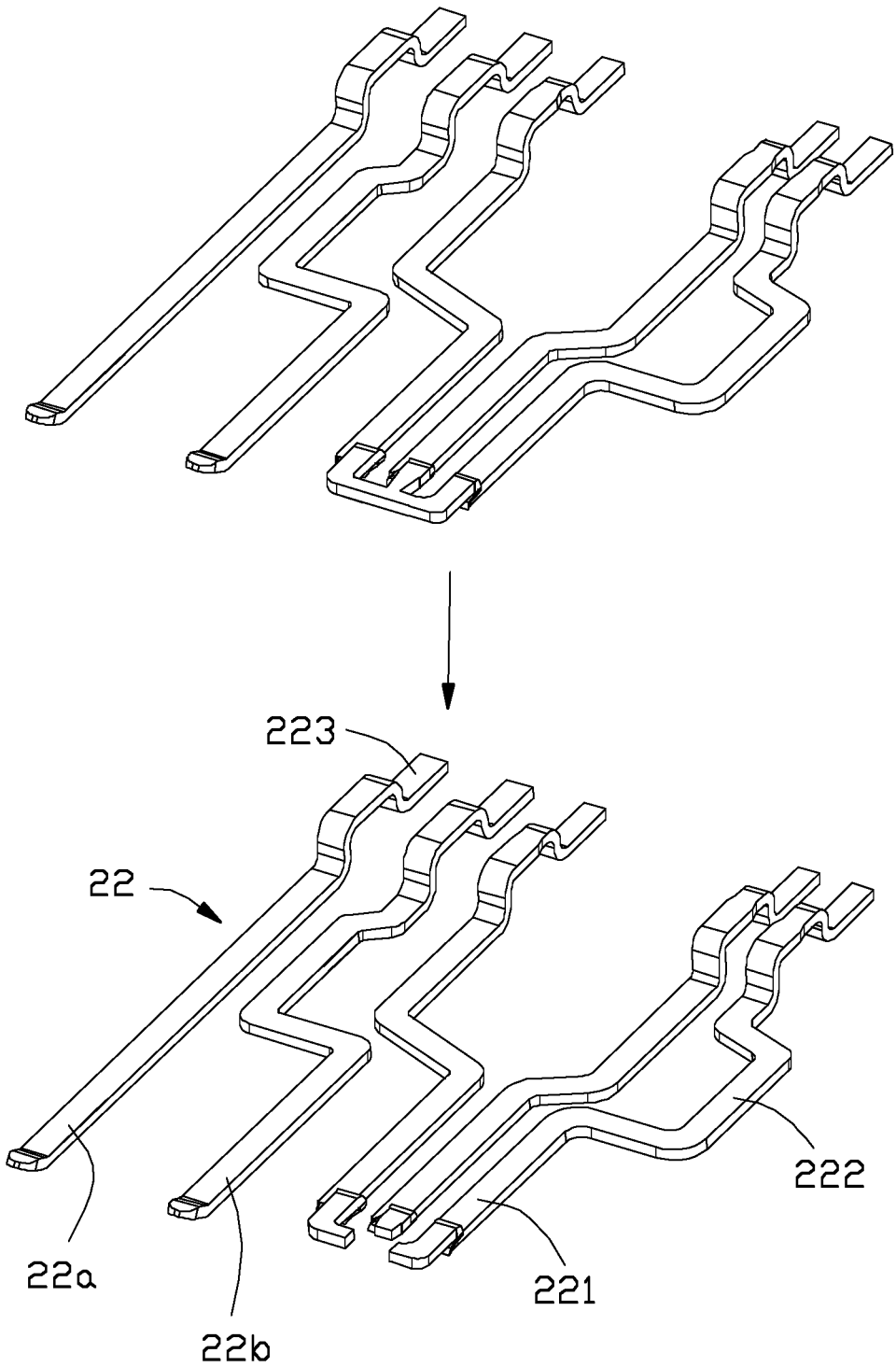
FIG. 7 is a perspective view showing the second contacts of the electrical connector connected with carriers cut.

Referring to FIG. 7, the neighboring second contacting portions 221 of the second contacts 22 are connected with each other in molding process and separated from each other via cutting the carriers between the free ends thereof.

Referring to FIG. 4, the metal sheet 3, shaping like a panel, includes a supporting portion 31 received in the insulative housing 1, and a soldering tail 32 extending backwardly and bent downwardly from the supporting portion 31.

Referring to FIGS. 1-4, the shielding shell 4 includes a top wall 41 and a bottom wall 42 located oppositely, and a pair of side walls 43 connected with the top wall 41 and the bottom wall 42. Each side wall 43 has a first affixed leg 431 extending laterally and bent downwardly and a second affixed leg 432 bent inwardly in a rear end. The second affixed legs 432 are resisted against by the base portion 11 of the insulative housing 1.

FIGS. 8-12 show an electrical connector 100' in a second embodiment. The electrical connector 100' includes an insulative housing 1, a number of terminals 2' and a metal sheet 3' retained in the insulative housing 1, a shielding shell 4' formed with a mating cavity to receive the insulative housing 1', and an insulative part 5'.

Figure 8:
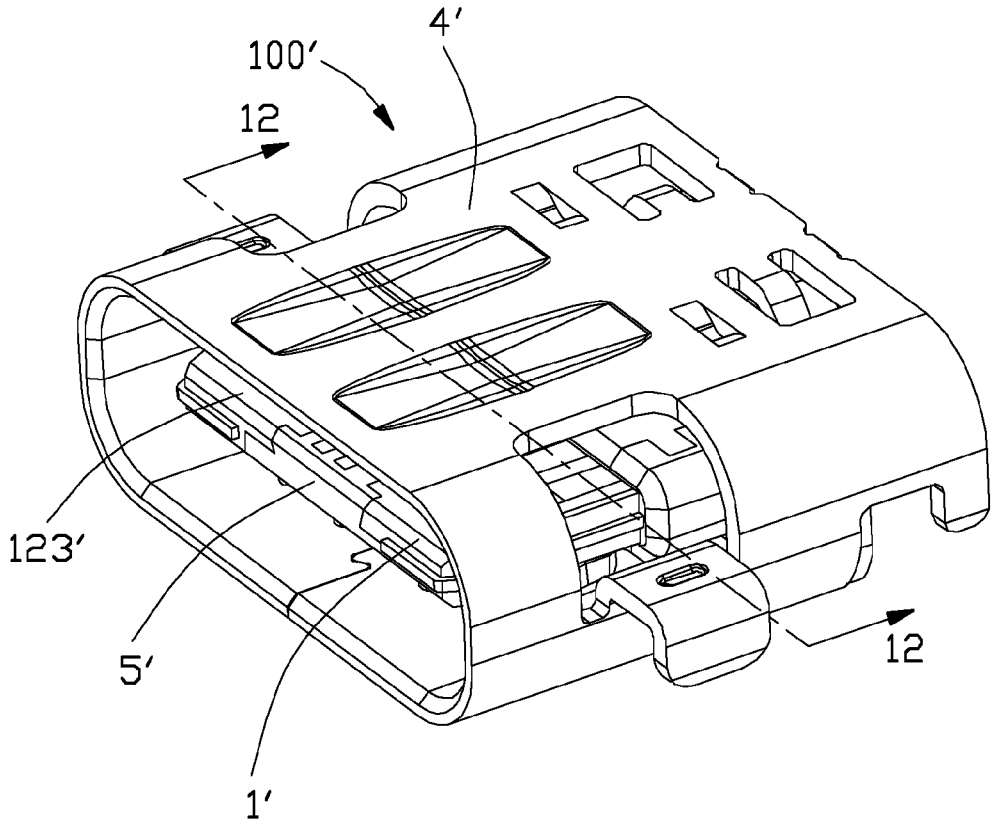
FIG. 8 is a perspective, assembled view of an electrical connector in a second embodiment.
Figure 9:
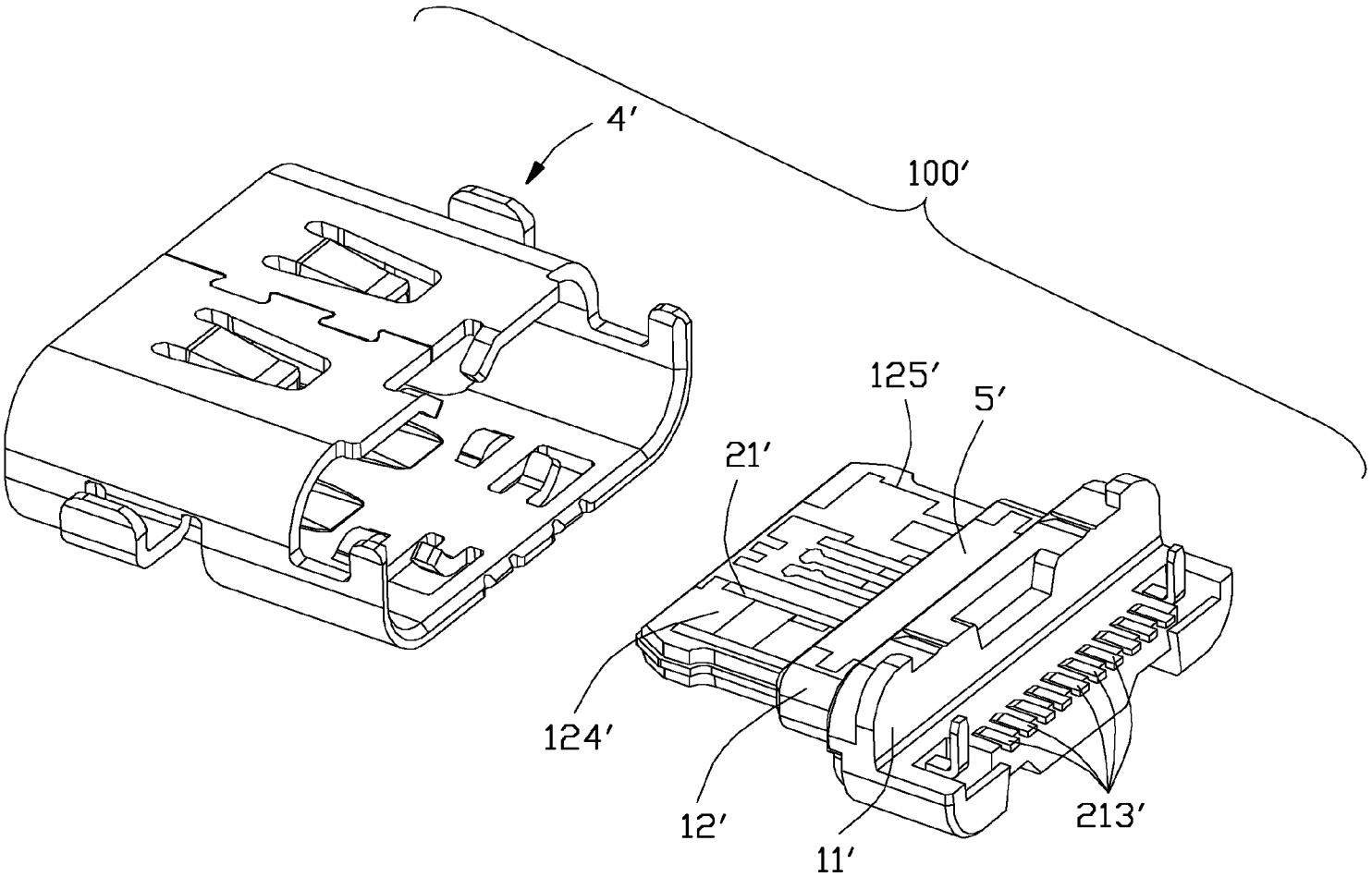
FIG. 9 is a perspective, assembled view of the electrical connector separated with a shielding shell.

Referring to FIGS. 8-9, the insulative housing 1' includes a base portion 11' and a tongue portion 12' extending forwardly from the base portion 11'. The tongue portion 12' defines a first surface 123' and a second surface 124' disposed oppositely. The first surface 123' and the second surface 124' have a number of terminal-receiving slots 10'. The tongue portion 12' has a number of hollow parts 125' to receive molds. The insulative part 5' is insert-molded in the tongue portion 12' to fill the hollow parts 125' beyond percolation.

Figure 10:
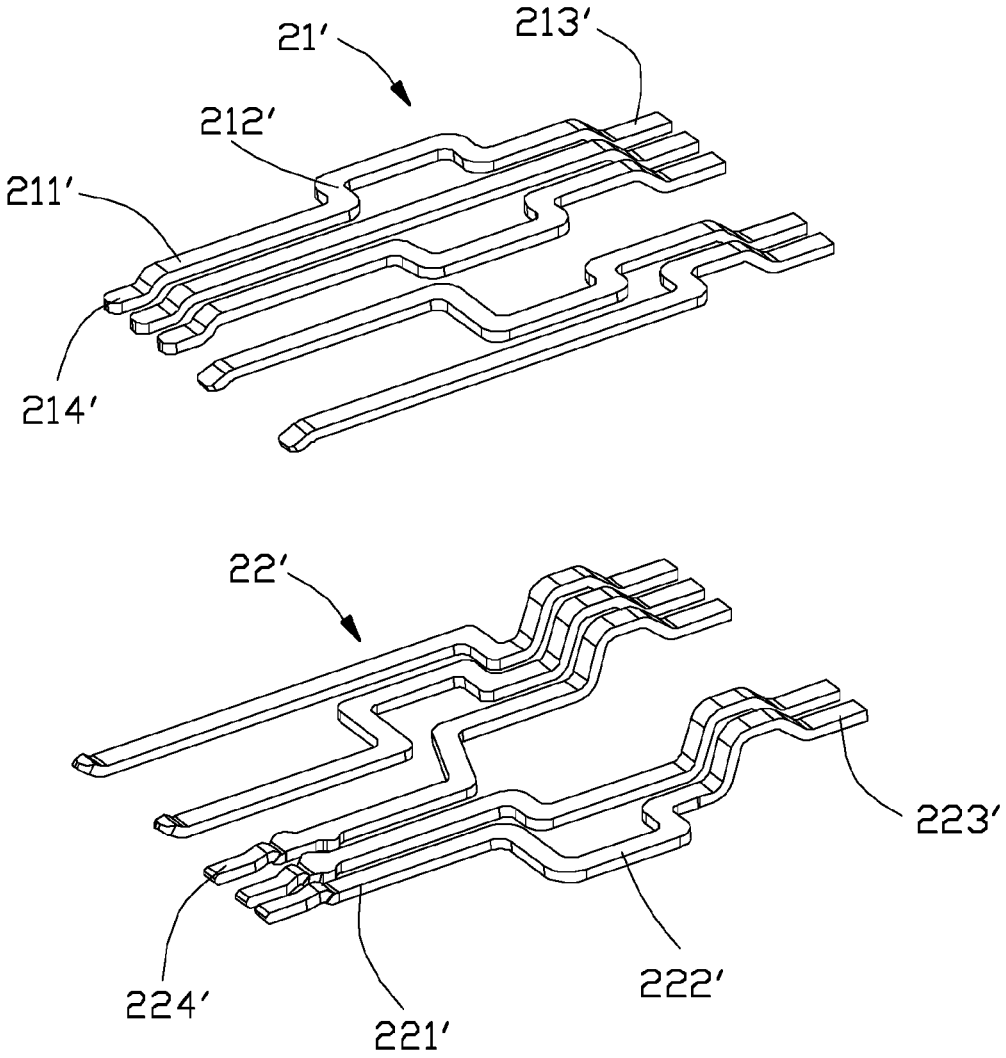
FIG. 10 is a perspective view of the contacts of the electrical connector in the second embodiment.
Figure 11:
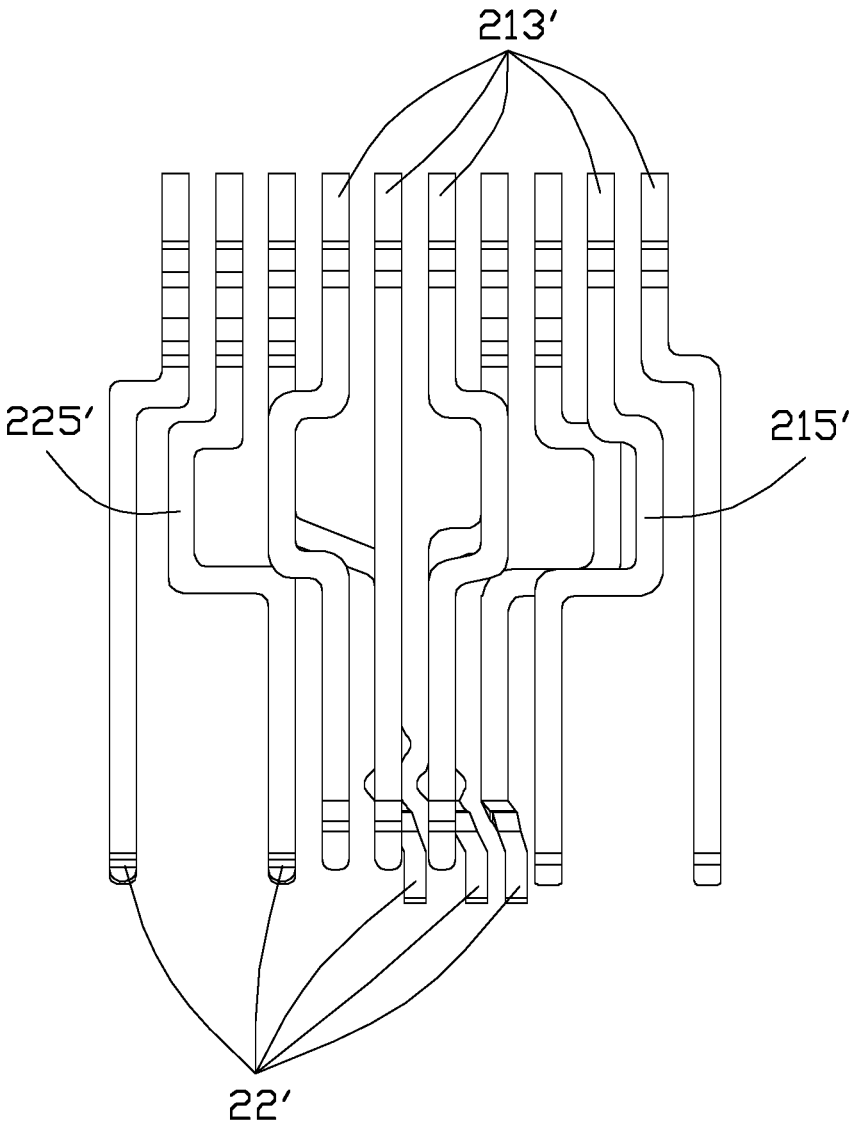
FIG. 11 is a vertical view of the contacts of the electrical connector in the second embodiment.

Referring to FIGS. 10-11, the terminals 2' includes a number of first contacts 21' carried by the terminal-receiving slots 10' in the first surface 123' and a number of second contacts 22' carried by the terminal-receiving slots 10' in the second surface 124'. Each of the first contacts 21' includes a first contacting portion 211' disposed in the first surface 123' of the tongue portion 12', a first soldering portion 213' extending from a back end of the base portion 11', and a first connecting portion 212' connected with the first contacting portion 211' and the first soldering portion 213'. Each of the second contacts 22' includes a second contacting portion 221' disposed in the second surface 124' of the tongue portion 12', a second soldering portion 223' extending from a back end of the second base portion 121', and a second connecting portion 222' connected with the second contacting portion 221' and the second soldering portion 223'.

The first contacts 21' and the second contacts 22' respectively define a number of vacant space therebetween. The vacant space receives no terminals 2' and extends through the terminal-receiving slots 10' in the transverse direction. At least one first connecting portion 212' of two neighboring first contacts 21' is bent along a direction away from another first contact 21' in the vacant space. The first connecting portion 212' defines a first middle portion 215' extending in a mating direction to increase a distance between the two neighboring first soldering portion 213' of the two neighboring first contacts 21' to form the vacant space. At least one second connecting portion 222' of two neighboring second contacts 22' is bent along a direction away from another second contact 22' in the vacant space. The first connecting portion 222' defines a second middle portion 225' extending in a mating direction to increase a distance between the two neighboring second soldering portion 223' of the two neighboring second contacts 22' to receive in the vacant space and line the first soldering portion 213' and the second soldering portion 223' in the transverse direction.

The first contacting portion 211' has a first Free end portion 214' extending downwardly from a free end thereof and the second contacting portion 221' has a second Free end portion 224' extending upwardly from a free end thereof. The first Free end portion 214' and the second Free end portion 224' extend to the metal sheet 3' to press the first Free end portion 214' and the second Free end portion 224' into the insulative housing 1' to enhance stability to prevent the terminals 2' perking in use.

Referring to FIG. 9, in a process the terminals 2' insert-molded with the insulative housing 1', the first contacts 21' and the second contacts 22' respectively have first resisting parts and second resisting parts resisted against by the molds. The first resisting parts are located at the first connecting portion 212' of some first contacts 21' and the first free end portions 214' of rest of the first contacts 21'. The second resisting parts are located at the second connecting portion 222' of some second contacts 22' and the second free end portions 224' of rest of the second contacts 22'. The first resisting part of the first connecting portion 212' and the second resisting part of the second connecting portion 222' respectively have first middle portions 215' and second middle portions 225' bent laterally and extending in the mating direction to offset in the transverse direction. The first free end portions 214' and the second free end portions 224' offset in the transverse direction to offset the first middle portions 215' and the second middle portions 225' in the transverse direction to be resisted against by the molds from the up-and-down direction easily in molding process.

Figure 12:
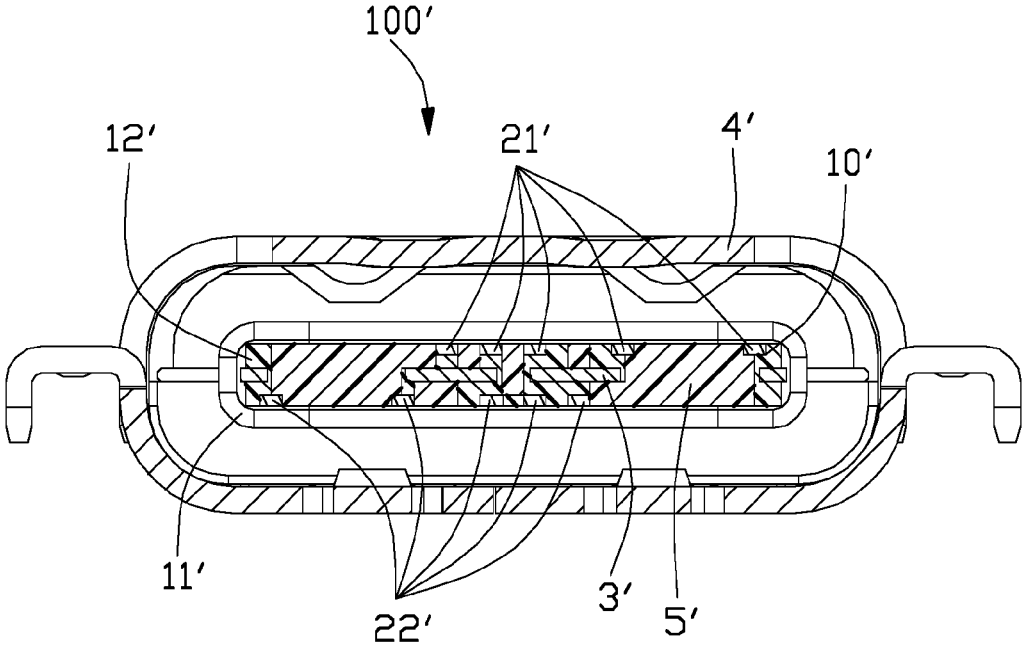
FIG. 12 is a cross-sectional view of the electrical connector along line 12-12 in FIG. 8.

Referring to FIG. 12, the first contacts 21' and the second contacts 22' are positioned to have 180 degree symmetry such that the corresponding plug connector can be inserted and operatively coupled to the electrical connector 100' in either of two orientations. The first contacts 21' and the second contacts 22' include a ground voltage, a supply voltage, a positive low-frequency signal, a negative low-frequency signal, and a testing signal. In this embodiment, the numbers of the first contacts 21' and the second contacts 22' are both five. Referring to FIG. 11, the first contacts 21' are placed in an order starting from one edge of the electrical connector 100' of a ground voltage for grounding, a supply voltage for providing power, a positive low-frequency signal, a negative low-frequency signal, and a testing signal. The second contacts 22' are placed in a reverse order starting from the same edge of the electrical connector 100' compared to the first contacts 21'.

Referring to FIG. 9, the first soldering portions 213' of the first contacts 21' and the second soldering portions 223' of the second contacts 22' are disposed in a line to decrease the height of the soldering-block of the electrical connector 100'. Referring to FIG. 11, the first soldering portions 213' of the ground voltage and the supply voltage of the first contacts 21' and the second soldering portions 223' of the ground voltage and the supply voltage of the second contacts 22' are placed in an edge to place the first soldering portion 213' of the positive low-frequency signal of the first contact 21' and the soldering portion 223' of the positive low-frequency signal of the second contact 22' therebetween. Referring to FIG. 8, according to a order from left to right, the first soldering portions 213' and the second soldering portions 223' are arranged in three second soldering portions 223', three first soldering portions 213', two second soldering portions 223', and two first soldering portions 213'.

Referring to FIG. 9, in a process of insert-molding the terminals 2' with the insulative housing 1', the first contacts 21' and the second contacts 22' respectively have first resisting parts and second resisting parts resisted against by the molds. The first resisting parts may be located at the first connecting portion 212' or the first Free end portion 214', and the second resisting parts may be located at the second connecting portion 222' or the second Free end portion 224'.

However, the disclosure is illustrative only, changes may be made in detail, especially in matter of shape, size, and arrangement of parts within the principles of the invention.

What is claimed is:

1. An electrical connector comprising:

an insulative housing having a base portion and a tongue portion extending forwardly from the base portion, the tongue portion defining a first surface and an opposite second surface;

a plurality of terminals disposed in the insulative housing and having a plurality of first contacts carried by the first surface and a plurality of second contacts carried by the second surface, each first contact having a first contacting portion exposed from the first surface, a first soldering portion extending from the base portion, and a first connecting portion connected with the first contacting portion and the first soldering portion, each second contact having a second contacting portion exposed from the second surface, a second soldering portion extending from the base portion, and a second connecting portion connected with the second contacting portion and the second soldering portion; and a shielding shell attached to the insulative housing, wherein the first contacts include a first outermost contact, and the first contacting portion of the first outermost contact is offset outwardly beyond the second contacting portions along a transverse direction, and wherein said first contacts comprise a first lateral contact located beside the first outermost contact, and the first lateral contact and the first outermost contact are staggered in a same direction so that the contacting portions of the plurality of second contacts are not disposed in an area of the second surface of the tongue portion corresponding to that between the contacting portion of the first outermost contact and the contacting portion of the first lateral contact.

2. The electrical connector as claimed in claim 1, wherein a distance between the first contacting portion of the first outermost contact and the contacting portion of the first lateral contact is larger than that of adjacent first contacting portions of other first contacts except for the first outermost contact and the first lateral contact.

3. The electrical connector as claimed in claim 1, wherein neighboring second contacting portions of the second contacts are connected with each other at free ends thereof in a molding process and then separated from each other by cutting.

4. The electrical connector as claimed in claim 1, wherein the first contacting portions and the second contacting portions offset to different directions along the transverse direction.

5. An electrical connector comprising:

an insulative housing having a base portion, a tongue portion extending forwardly from the base portion, and two rows of terminal-receiving slots, the tongue portion defining a first surface and an opposite second surface;

a plurality of terminals disposed in the insulative housing and having a plurality of first contacts and a plurality of second contacts positioned to have 180 degree symmetry, each first contact having a first contacting portion exposed from the first surface, a first soldering portion extending from the base portion, and a first connecting portion connected with the first contacting portion and the first soldering portion, each second contact having a second contacting portion exposed from the second surface, a second soldering portion extending from the base portion, and a second connecting portion connected with the second contacting portion and the second soldering portion; and a shielding shell attached to the insulative housing, wherein the first contacts and the second contacts respectively define a vacant space therebetween in the transverse direction, wherein at least one first connecting portion of two neighboring first contacts is bent along a first direction away from other first contacts in the vacant space to increase a distance between the two neighboring first soldering portions of said two neighboring first contacts to form a first receiving space to receive the second soldering portions, wherein at least one second connecting portion of two neighboring second contacts is bent along a second direction opposite to the first direction and away from other second contacts in the vacant space to increase a distance between the two neighboring second soldering portions of said two neighboring second contacts to form a second receiving space to receive the first soldering portions, and wherein the first soldering portions and the second soldering portions are arranged in a line and staggered in sequence as a plurality of groups along the transverse direction.

6. The electrical connector as claimed in claim 5, wherein the first soldering portions and the second soldering portions are arranged in sequence as three second soldering portions, three first soldering portions, two second soldering portions, and two first soldering portions.

7. The electrical connector as claimed in claim 5, wherein the first soldering portions of the first contacts are to transmit positive and negative signals and are configured adjacently between the second soldering portions of the second contacts that transmit positive and negative signals.

8. The electrical connector as claimed in claim 7, wherein the first contacts are configured in an order starting from one edge of the electrical connector of a ground voltage, a supply voltage, a positive low-frequency signal, a negative low-frequency signal, and a testing signal, and the second contacts are configured in a reverse order starting from the same edge of the electrical connector compared to the first contacts.

9. An electrical connector comprising:

an insulative housing having a base portion and a tongue portion extending forwardly from the base portion, the tongue portion defining a first surface and an opposite second surface;

a plurality of terminals disposed in the insulative housing and having a plurality of first contacts carried by the first surface and a plurality of second contacts carried by the second surface, each first contact having a first contacting portion exposed from the first surface, a first soldering portion extending from the base portion, and a first resisting portion, each second contact having a second contacting portion exposed from the second surface, a second soldering portion extending from the base portion, and a second resisting portion, the first resisting portions and the second resisting portions viewed in an up-and-down direction being offset in a transverse direction; and a shielding shell attached to the insulative housing.

10. The electrical connector as claimed in claim 9, wherein each first contact has a first connecting portion between the first contacting portion and the first soldering portion, each second contact has a second connecting portion between the second contacting portion and the second soldering portion, the first resisting portions are located at the first connecting portions, the second resisting portions are located at the second connecting portions, and each first resisting portion and each second resisting portion protrude laterally to form a first middle portion and a second middle portion extending in the mating direction and offset in the transverse direction.

11. The electrical connector as claimed in claim 9, wherein each first resisting portion is formed in a first free end portion located at a front end of the first contacting portion, each second resisting portion is formed in a second free end portion located at a front end of the second contacting portion, and the first free end portions and the second free end portions are offset in the transverse direction.

12. The electrical connector as claimed in claim 11, wherein each of the first free end portions extends downwardly from the first contacting portion, each of the second free end portions extends forwardly from the second contacting portion, and the second free end portions protrude laterally to offset the corresponding first free end portions.

* * * * *